US005601239A

United States Patent [19]

Smith et al.

[11] Patent Number: 5,601,239

[45] Date of Patent: Feb. 11, 1997

[54] BULK MATERIAL SHREDDER AND METHOD

[75] Inventors: Greg M. Smith, St. Louis; Thomas Harrawood, Leslie, both of Mo.

[73] Assignee: Wood Waste Energy, Inc., St. Louis, Mo.

[21] Appl. No.: 498,236

[22] Filed: Jul. 5, 1995

[51] Int. Cl.[6] ..... B02C 19/22

[52] U.S. Cl. ..... 241/29; 241/79.1; 241/260.1; 241/294

[58] Field of Search ..... 241/29, 79.1, 260.1, 241/294, 78

[56] References Cited

U.S. PATENT DOCUMENTS

| | | | |
|---|---|---|---|
| 681,984 | 9/1901 | Schoellhorn . | |
| 2,149,571 | 3/1939 | Battey | 83/11 |
| 2,784,987 | 3/1957 | Corcoran | 285/87 |
| 3,829,030 | 8/1974 | Wallenfang et al. | 241/89.1 |
| 3,968,998 | 7/1976 | Wolf | 241/260.1 |
| 4,009,836 | 3/1977 | Strom et al. | 241/73 |
| 4,040,571 | 8/1977 | Lindeborg | 241/30 |
| 4,042,183 | 8/1977 | Cumpston | 241/292.1 |
| 4,133,489 | 1/1979 | Maillet | 241/89 |
| 4,182,592 | 1/1980 | Henryson | 414/412 |
| 4,253,615 | 3/1981 | Koenig | 241/36 |
| 4,457,058 | 7/1984 | Binder et al. | 241/294 X |
| 4,632,317 | 12/1986 | Wexell et al. | 241/30 |
| 4,697,750 | 10/1987 | Prew | 241/247 |
| 4,767,065 | 8/1988 | Wray | 241/152 |
| 4,891,099 | 1/1990 | Silveri et al. | 241/78 X |
| 4,976,471 | 12/1990 | Holgersson | 241/73 |
| 4,978,078 | 12/1990 | Vadnay | 241/74 |
| 5,011,088 | 4/1991 | Savonjousi | 241/21 |
| 5,108,040 | 4/1992 | Koenig | 241/260.1 |
| 5,148,999 | 9/1992 | Curfman et al. | 241/260.1 |
| 5,269,355 | 12/1993 | Bowen | 144/223 |
| 5,356,054 | 10/1994 | Loppoli et al. | 241/236 X |
| 5,443,588 | 8/1995 | Loppoli | 241/260.1 X |

OTHER PUBLICATIONS

The Torrington Company Service Catalog, 1988.

*Primary Examiner*—John M. Husar

*Attorney, Agent, or Firm*—Senniger, Powers, Leavitt & Roedel

[57] ABSTRACT

A bulk material shredding method, a bulk material shredder which has a shredder housing having a trough, a discharge end having a discharge aperture for discharge of shredded material out of the trough, and an opposite end remote from the discharge end, an auger mounted for rotation within the shredder housing and retained by a bearing surface at the discharge end of the shredder housing and by a bearing surface at the opposite end of the shredder housing, the auger having a uniform diameter auger flight, and a shaft of uniform diameter through its length which carries the auger flight. A drive means is located at the discharge end of the shredder housing for rotating the auger and a plurality of teeth are mounted on the periphery of the auger and project radially therefrom. Apparatus for shredding railroad ties and separating non-fuel useable components therefrom to produce fuel.

15 Claims, 5 Drawing Sheets

54
36
72
74
70
28
97

BULK MATERIAL SHREDDER AND METHOD

BACKGROUND OF THE INVENTION

This invention relates to a bulk shredder for shredding bulk material including plastic or wood material, construction and demolition waste, other fracturable or shreddable wood or plastic products, and especially railroad ties, utility poles and the like. The invention also relates to a method for shredding such material.

For shredding large objects such as railroad ties and demolition waste, it has been known to use heavy duty shredders which include a rotating auger within a shredding chamber. The material to be shredded is typically fed into one end of such a device and moved down the length of the shredding chamber by the auger towards a discharge end.

U.S. Pat. No. 5,108,040 discloses an auger shredder having a tapered auger which causes material to be shredded by the meshing of teeth on the auger periphery with breaker bars affixed to the shredding chamber. The auger is pinned at the input end of the shredder, where a drive motor for the auger is located, while the opposite end of the auger extends into an extrusion tube.

U.S. Pat. No. 4,976,471 discloses a mill for the comminution of plastic or wood into smaller pieces. The mill has a feeder screw which is driven by a motor with a discharge funnel adjacent the drive end.

U.S. Pat. Nos. 4,767,065, 5,011,088, and 4,632,317 also show auger-type material disintegrating devices having alternative designs.

U.S. Pat. No. 4,133,489 shows a shredding device having grate segments which are pivotably mounted at one end and moved at the other end by means of hydraulic jacks. U.S. Pat. No. 681,984 shows a pulverizer in which the lower screen is adjustable upward to accommodate for wear of the beater. U.S. Pat. Nos. 2,149,571, 3,829,030, and 4,009,836 show other pulverizers or hammer mills provided with adjustable grates or screens.

U.S. Pat. Nos. 4,042,183, 5,269,355, 5,148,999, and 4,978,078 show various configurations of various projections or teeth on augers for comminuting material.

Although certain of the prior designs such as that shown in U.S. Pat. No. 5,108,040 have proven to be adequate for shredding bulk material such as railroad ties, utility poles and the like, they suffer from certain inefficiencies. In particular, the auger teeth on certain such devices are not easily replaceable or are not configured for most efficiently shredding railroad ties and the like. The breaker bars on the shredder trough are not configured and oriented for most efficiently cooperating with the action of the auger teeth to shred such materials. Certain devices have a tapered auger or a drive means located at the end opposite the shredder's discharge end, which have been discovered to be undesirable for certain shredding operations. Also, they do not have the most effective bearing systems at both the drive end and opposite end of the auger shaft.

SUMMARY OF THE INVENTION

It is an object of this invention to provide an improved shredder of increased durability and productivity; to provide such a shredder especially suited for shredding railroad ties to permit magnetic removal of metallic components thereof; and to provide an improved method for shredding bulk material, especially railroad ties, utility poles and the like.

Briefly, therefore, the invention is directed to a shredder for shredding solid fracturable material having a shredder housing having side walls, a trough, a discharge end having a discharge aperture for discharge of shredded material out of the trough, and an opposite end remote from said discharge end. There is an auger mounted for rotation within the shredder housing and a drive means for rotating the auger. There is a plurality of teeth mounted on the periphery of the auger and projecting radially therefrom, at least some of the teeth having a leading shredding component at a leading edge of each tooth as the auger is rotated during normal operation and a trailing shredding component at a trailing edge of each tooth as the auger is rotated during normal operation, the leading component leading the trailing component in the auger's direction of rotation during normal operation, there being a space between the leading component and the trailing component for receiving material therein for pulling the material in the direction of rotation.

The invention is also directed to a shredder having a shredder housing and an auger mounted for rotation within the shredder housing and retained by a bearing surface at the discharge end of the shredder housing and by a bearing surface at the opposite end of the shredder housing, the auger having a uniform diameter auger flight and a shaft of uniform diameter through its length which carries the auger flight. A drive means located at the discharge end of the shredder housing rotates the auger and a plurality of teeth mounted on the periphery of the auger project radially therefrom.

The invention is also directed to a shredder having a shredder housing having a trough with shredder blocks affixed to the trough. At least some of the shredder blocks are of generally rectangular conformation and have a bottom surface flush with the trough, a top surface opposite the bottom surface, and four side surfaces. The blocks are arranged on the trough in oblique relation relative to the auger's direction of rotation such that a corner of each block is disposed for first contact with material moving in the auger's direction of rotation.

The invention is further directed to a shredder having a shredder housing and an auger mounted for rotation within the shredder housing and retained by two thrust bearings in spaced relation to each other at the discharge end of the shredder housing and by a bearing surface at the opposite end of the shredder housing. There is a drive means for rotating the auger and a plurality of teeth mounted on the periphery of the auger and projecting radially therefrom.

The invention is still further directed to a shredder having a shredder housing having a trough, a discharge end having a discharge aperture for discharge of shredded material out of said trough and an opposite end remote from the discharge end. There is an auger mounted for rotation within the shredder housing and retained by a bearing surface at the discharge end of the shredder housing and by a bearing surface at the opposite end of the shredder housing. The auger has a uniform diameter auger flight, a shaft of uniform diameter in a section of the auger which carries said flight, and a drive means located at the discharge end of the shredder housing for rotating the auger. There is a plurality of teeth affixed to the periphery of the auger and projecting radially therefrom, at least some of the teeth having a leading shredding component at a leading edge of each tooth as the auger is rotated and a trailing shredding component at a trailing edge of each tooth as the auger is rotated, the leading component leading the trailing component in the auger's direction of rotation during normal operation, there being a space between the leading component and the trailing component for receiving material therein for pulling the material in the auger's direction of rotation, each tooth further having a sharp forwardly pointing shredder point on a leading edge of the trailing shredding component of said tooth. There is a plurality of shredder blocks affixed to the trough, at least some of which are of generally rectangular conformation and have a bottom surface flush with the trough, a top surface opposite the bottom surface, and four side surfaces. The blocks are arranged on the trough in oblique relation relative to the direction of rotation such that a corner of each block is disposed for first contact with material moving in the direction of rotation.

The invention is also directed to an apparatus for shredding railroad ties to produce fuel therefrom. The apparatus has a primary shredder having a shredder housing having a trough, a discharge end having a discharge aperture for discharge of shredded material out of the trough, and an opposite end remote from the discharge end. There is an auger mounted for rotation within the shredder housing. The apparatus also has a first conveyor for carrying shredded material discharged from the primary shredder away from the primary shredder, a primary magnetic separator for removing metal components from shredded material discharged from the primary shredder, a secondary shredder for further shredding material discharged from the primary shredder, a second conveyor for carrying shredded material discharged from the secondary shredder away from the secondary shredder, and a secondary magnetic separator for removing metal components from material discharged from the secondary shredder.

Additionally, the invention relates to a method for shredding solid fracturable material in which an auger is rotated within shredder housing having a trough, a discharge end having a discharge aperture for discharge of shredded material out of said trough, and an opposite end remote from the discharge end, the material is placed within the housing and in contact with the auger so that teeth mounted on the periphery of the auger and projecting radially therefrom impact the material and cause it to be pulled against shredder blocks mounted on the trough. At least some of the teeth have a leading shredding component at a leading edge of the tooth as the auger is rotated and a trailing shredding component at a trailing edge of the tooth as the auger is rotated, there being a space between the leading component and the trailing component for receiving material therein for pulling the material in the auger's direction of rotation, each tooth further having a sharp forwardly pointing shredder point on a leading edge of the rearward shredding component of the tooth. Each of the shredder blocks is positioned so as not to contact any of said teeth upon rotation of auger. The blocks are of generally rectangular conformation and have a bottom surface flush with the trough, a top surface opposite the bottom surface, and four side surfaces. The blocks are oriented on the trough such that planes corresponding to their side surfaces are oblique to the longitudinal axis of the auger shaft.

Other objects and features of the invention will be in part apparent and in part pointed out hereinafter.

BRIEF DESCRIPTION OF THE DRAWINGS

Corresponding parts are designated by corresponding reference numerals throughout the several views of the drawings.

DETAILED DESCRIPTION OF THE INVENTION

Figures 1, 2, 3, 4, 5, 6, 7:
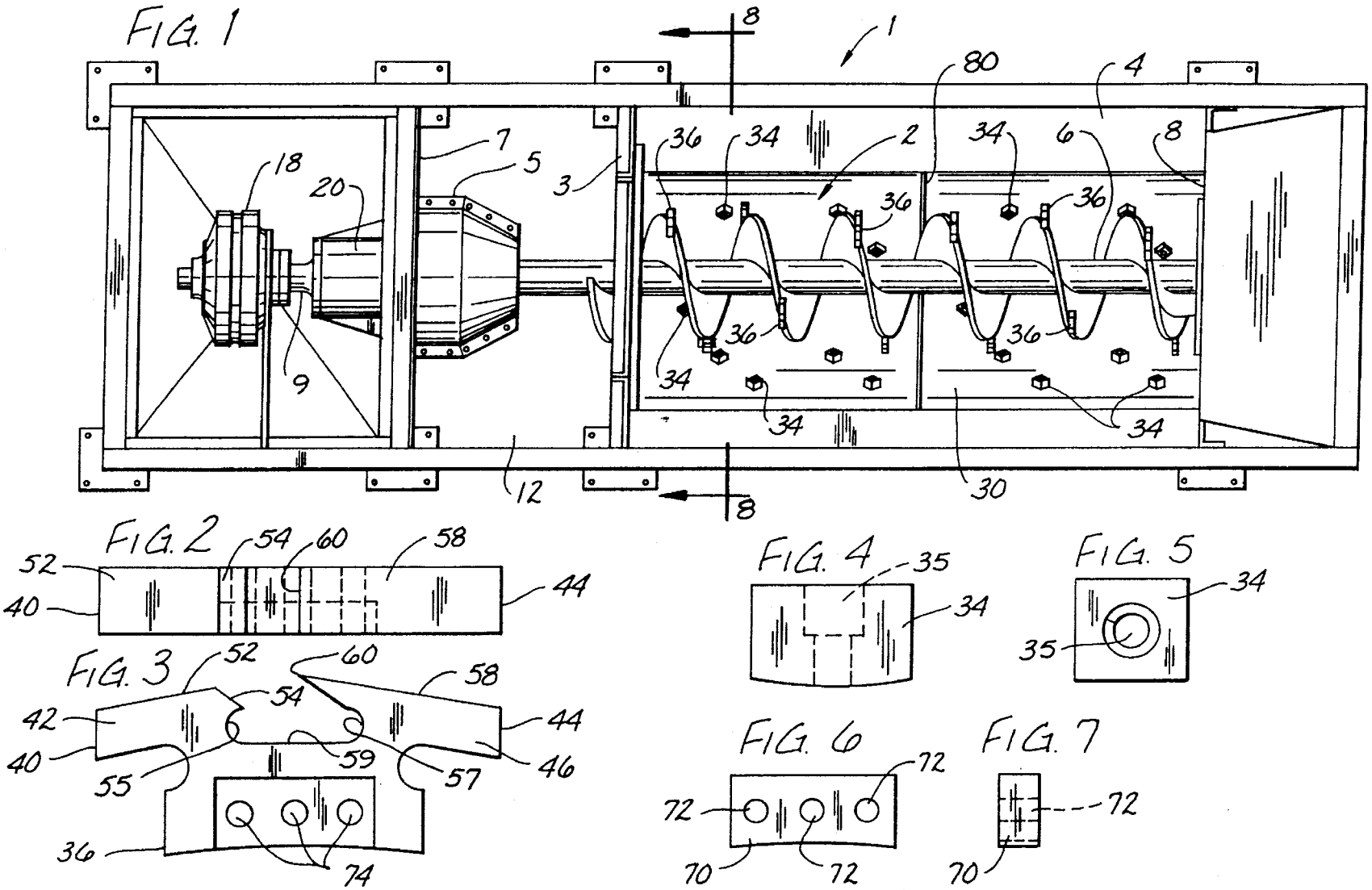
FIG. 1 is a schematic top view of the shredder of the invention.
FIG. 2 is a top view of shredding teeth of the type affixed to the auger of the shredder.
FIG. 3 is a side view of shredding teeth of the type affixed to the auger of the shredder.
FIG. 4 is a side view of a shredder block of the type affixed to the trough of the shredder.
FIG. 5 is a top view of shredder blocks of the type affixed to the trough of the shredder.
FIG. 6 is a side view of a seat of the type for affixing a tooth to the shredder auger.
FIG. 7 is an end view of a seat of the type for affixing a tooth to the shredder auger.

Referring now to FIG. 1, a device of this invention is shown generally at 1. The shredder includes an auger 2 which is preferably about 12 feet long and is positioned inside of a shredding chamber 4 through which the material being shredded is moved by the action of the auger. The diameter of the flight 28 (FIG. 8) of the auger 2 is uniform down the entire length of the auger and the diameter of that portion of the auger shaft which carries the flight is uniform.

There is a head wall 3 having an extrusion hole therein, which is preferably 3'10" in diameter through which shredded material is extruded. The head wall 3 separates the shredding chamber 4 from a coupler chamber wherein the auger shaft enters coupler housing 5. The coupler chamber is separated from a drive motor chamber by wall 7, and the auger shaft 6 is connected to a drive shaft 9 at the coupler within coupler housing 20. Although the drive motor chamber, coupler chamber and shredding chamber are all shown in FIG. 1 as open, only the coupler chamber and shredding chamber are open during operation. The shredding chamber, coupler chamber and drive motor chamber are about 12 feet, 4 feet and 10 feet in length, respectively.

Figure 9:
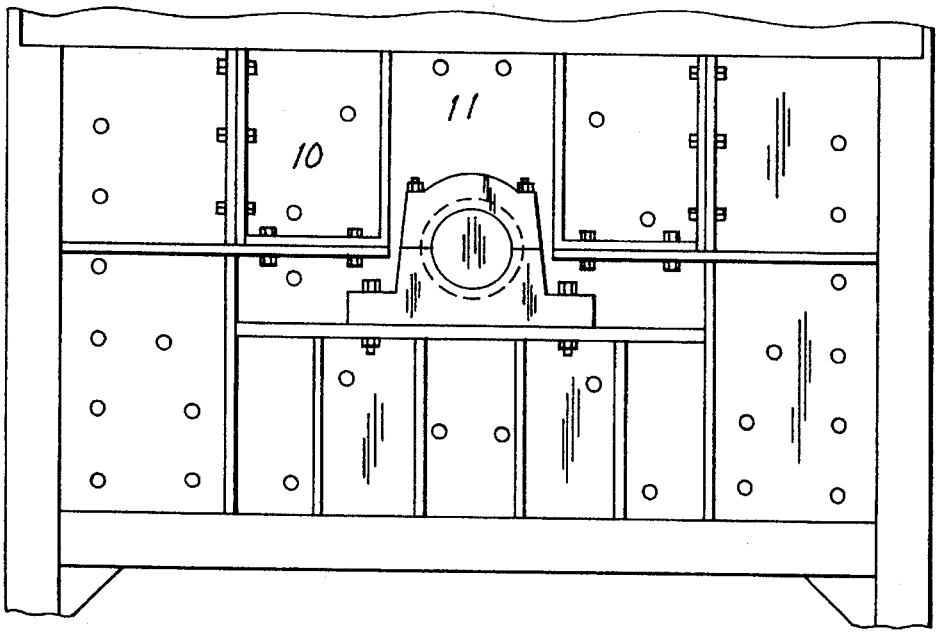
FIG. 9 is a schematic end view of the shredder viewed from the fixed end of the shredder.
Figure 10:
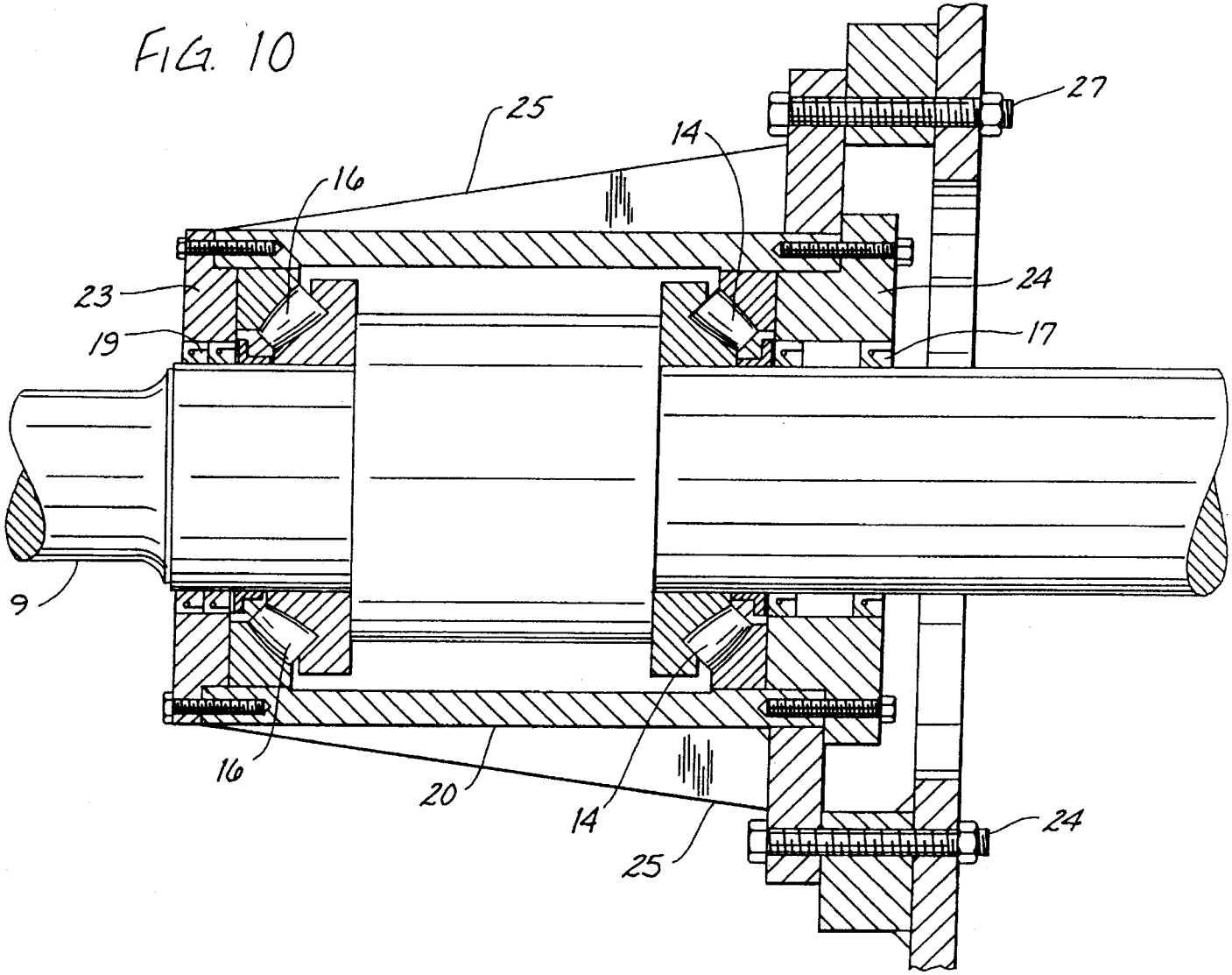
FIG. 10 is a view of bearing housing 20 shown partially in section.

The auger shaft is pinned at the fixed end 8 of the shredding chamber opposite the discharge end and seated within a spherical roller bearing 10 in pillow block bearing housing 11 as seen in FIG. 9. At the discharge end 12 of the shredding chamber the auger shaft is seated within two thrust bearings 14, 16 approximately eleven inches apart as seen in FIG. 10 within bearing housing 20 (FIG. 1). There is an expanded shaft portion between the thrust bearings as seen in FIG. 10, and compression fit seals 17 and 19 seal lubricant within the bearing system. Removable caps 21 and 23 provide access to the bearing system for inspection and replacement. Gussets 25 stabilize the bearing housing and fasteners 27 secure the bearing housing to wall 7. At this discharge end the auger is pinned to a drive motor assembly 18.

Shredder members 34 have adjacent side walls which define a corner to assist in shredding. Members 34 are preferably blocks of generally rectangular conformation which are fixedly attached to the bottom of the trough to assist teeth 36 on the auger periphery in shredding material.

The shredder blocks 34 are most preferably square blocks arranged in diagonal rows as viewed from above the shredder (FIG. 1). Each row of shredder blocks consists of at least three blocks, preferably five blocks, and there is one row of such blocks for each helical turn of the auger. The blocks are oriented so that the planes corresponding to each of its side edges are oblique to the auger shaft, preferably such that they intersect the auger shaft at an angle of between about 30° and 60°, more preferably about 45°. By orienting the square blocks in this manner, rather than such that the stated planes intersect the auger shaft at about 90° or are parallel thereto, it has been discovered that efficiency of the shredding operation is improved because material moved in the direction down the shredder toward the discharge end and material pulled by the teeth toward the auger shaft are forced against a point on the shredder blocks, as opposed to against a flat surface. By forcing the material against a point rather than a blunt surface in this manner, shredding forces are concentrated and used more efficiently. As shown in FIGS. 4 and 5, each shredder block 34 has a hole therethrough 35 to facilitate attachment to the trough with a bolt. The shredder blocks are readily replaceable. The shredder blocks may have other than a rectangular shape and still fall within the scope of this invention.

Figure 8:
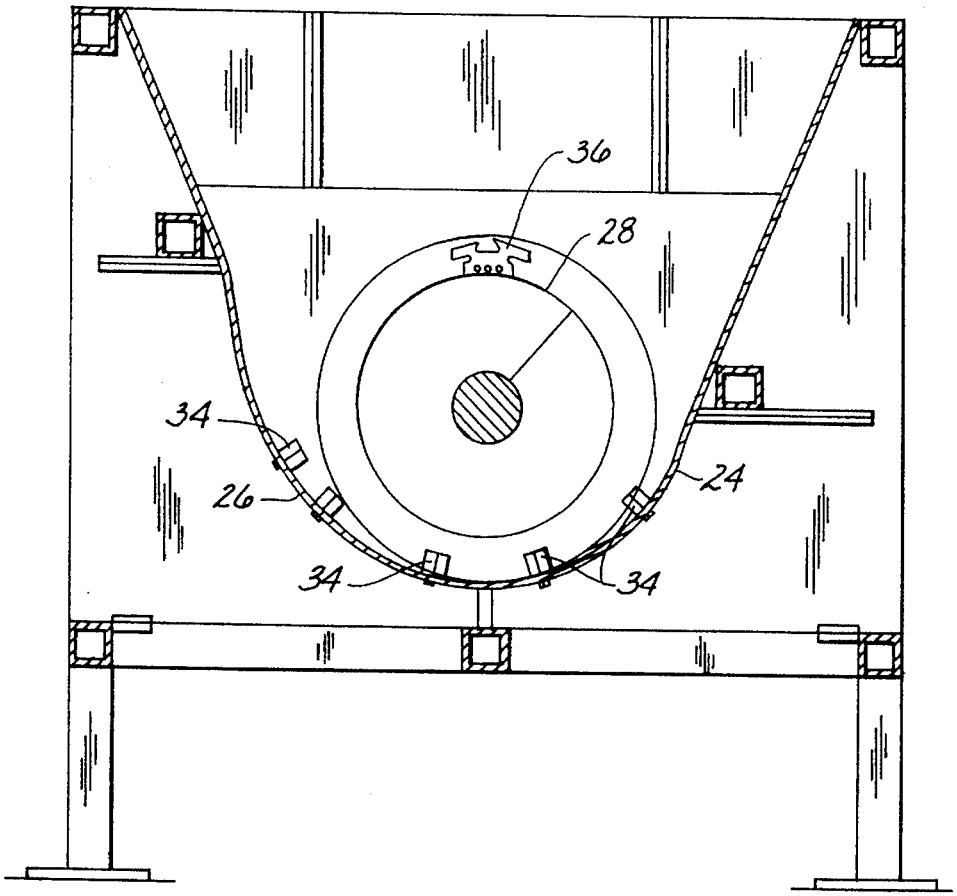
FIG. 8 is a cross section taken along line 8—8 of FIG. 1.
Figure 11:
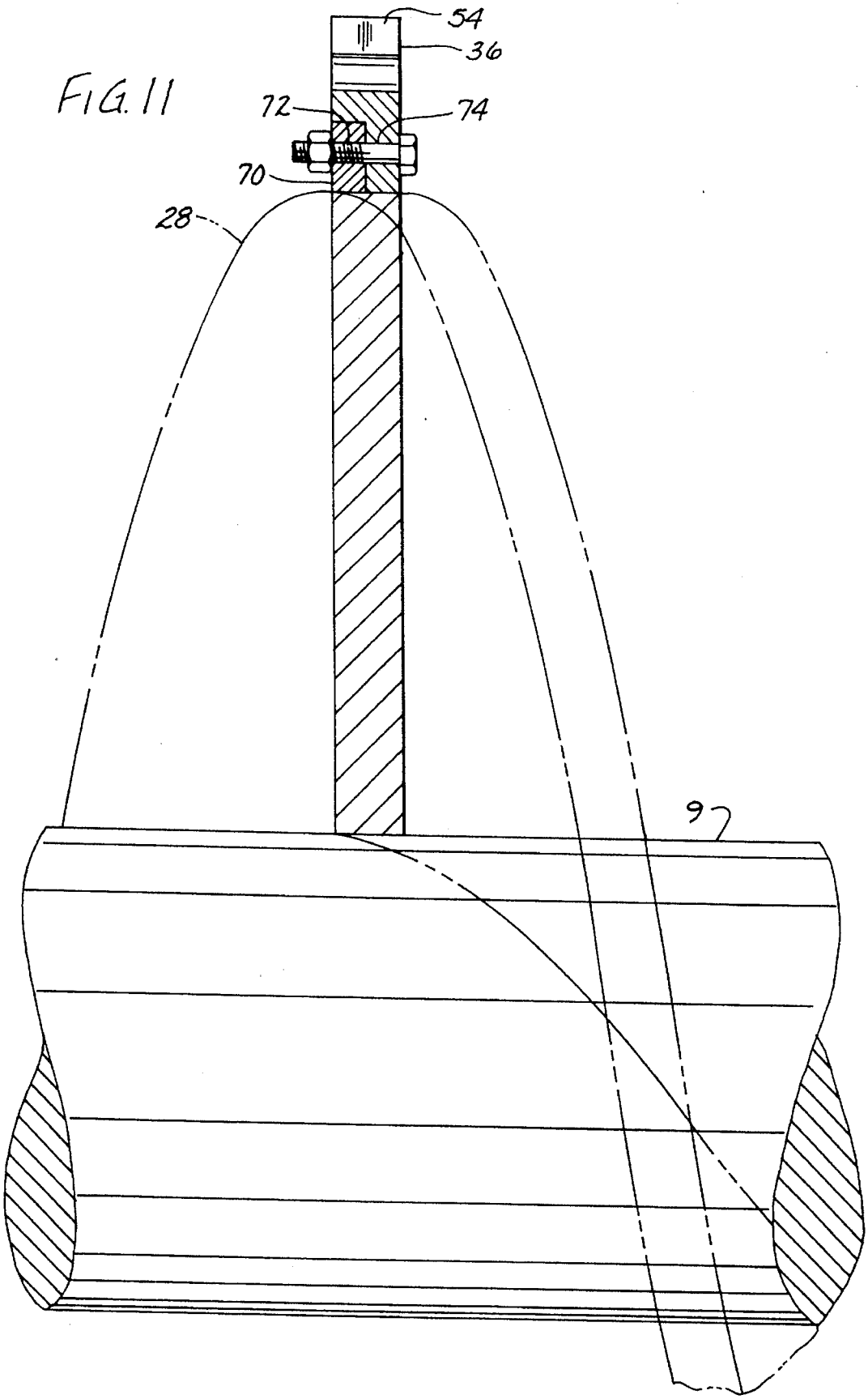
FIG. 11 is a partial section through an auger, auger blade, and tooth assembly.

The shredder teeth 36 are affixed to the periphery of the auger to facilitate shredding material as the teeth pull the material between the stationary shredder blocks. The teeth pull material against and between the blocks, shredding the material and leaving a portion of the material on the outer surface of the blocks while pulling a portion of the material towards and underneath the auger shaft. The components of the teeth and their relative orientation will now be described when considering each tooth at a position and orientation corresponding to the apex of the rotating auger as shown in FIGS. 8 and 11. The direction of rotation of the auger refers to a forward direction during normal operation, as opposed to reverse rotation which occurs temporarily on occasion as necessary to free material which causes the auger to jam. Turning now to FIGS. 3 and 4, each tooth 36 has a substantially vertical leading edge surface 40 on its leading shredding component 42 and a substantially vertical trailing edge surface 44 on its trailing shredding component 46. Immediately behind the vertical leading edge 40 is a first edge surface 52 which slopes upwardly from its leading end to its trailing end, the leading end being the end closest to the leading edge of the tooth and leading the trailing component during rotation of the auger. Immediately behind the first edge surface 52 is second edge surface 54, which second edge surface slopes downwardly from its leading end to trailing end. Spaced behind the leading shredding component is a trailing shredding component 46 having an edge surface 58 which slopes downwardly from its leading end to its trailing end. The leading edge on the trailing shredding component has a relatively sharp shredder point 60 of convergence of less than 90°, preferably less than about 60°, more preferably about 30°–45°. This tooth configuration has been discovered advantageous for shredding, especially for shredding fibrous material such as railroad ties, utility poles and the like. The substantially vertical leading edge 40 of the leading shredding component impacts the material to be shredded and pulls it against the shredder blocks. Fibrous material has a tendency to expand upon such action, rendering it especially amenable to being grabbed by sharp point 60 of the trailing shredding component and pulled between the shredder blocks. The void defined by the spaced relation between the leading and trailing shredding components of the teeth is configured to receive material therein and facilitates this grabbing action, as material is received within the void. It is preferred that the general dimensions of this space be between about 2 and 6 inches wide from leading edge 55 to trailing edge 57 and between about 1 and 6 inches deep from the highest point on the shredder point 60 to the bottom edge 59 of the space. In the most preferred embodiment, this space is about 3½ to 4 inches wide from leading edge to trailing edge and between about 1½ to 2½ inches deep from the shredder point to the bottom of the space. It is not required that all of the teeth on the auger have the configuration described above, but it is preferred.

For attachment of a tooth to the auger, a shank 70 is welded to the auger periphery, and the tooth attached thereto by appropriate fasteners, preferably bolts through holes 72 in the shank and holes 74 in the tooth. The teeth are therefore easily replaceable. As shown in FIG. 11, each tooth is oriented on the auger periphery such that its longitudinal axis is substantially perpendicular to the longitudinal axis of the auger shaft. Upon rotation of the auger, this orientation provides for substantially perpendicular impact of the teeth with material such as railroad ties, utility poles and the like which are laid lengthwise in the shredding chamber and also minimizes the application of twisting forces to the teeth. The teeth are located about one every 45 degrees around the auger periphery. Advantageously, by increasing or decreasing the frequency and number of teeth, the degree of shredding can be increased or decreased, and the shredder can be modified to accept different types of material.

As illustrated in FIG. 8 the clearance of the teeth with the bottom of the shredding trough is relatively close, but this clearance and the size of the shredding chamber are advantageously adjustable. From the view of the trough in FIG. 1, there is a first trough panel dividing line 80 perpendicular to the auger shaft and a second trough panel dividing line which is not visible in FIG. 1, since it is directly underneath the auger shaft. The trough comprises four removable trough panels defined by these dividing lines. As viewed in FIG. 8, by removal of trough panels of one size and replacement with trough panels of another size, the radius of the trough underneath the auger can be increased to permit the shredding of larger material or it can be decreased to facilitate shredding into finer pieces.

As shown in FIG. 9, the auger shaft is supported at the fixed end of the shredder by a spherical roller bearing 10 within a bearing housing 11. This helps to minimize deflection of the auger shaft and damage to the shredder when especially rigid material or material of irregular shape would otherwise cause deflection in the shaft. Two thrust bearings 14, 16 in FIG. 10 support the shaft at the drive end, or discharge end, of the shredder.

In the preferred embodiment the auger flight and trough are constructed of wear resistant, hardened b½ inch thick T1 steel and the auger shaft is constructed of 9½ inch diameter mild steel. The auger flight is welded to the auger shaft.

The preferred embodiment also includes a pressure-sensitive anti-jamming mechanism. If material becomes jammed in the shredder and significantly inhibits rotation of the auger until 5000 psi in force builds up against the auger, the auger automatically reverses itself for a few seconds to attempt to free the material inhibiting forward rotation. The auger then reverses itself again and re-strokes in the forward direction.

Although the advantages of the invention are realized in shredding a wide variety of bulk plastic and wood materials, it has been discovered that by use of the arrangement of features described herein, the shredder is especially suited for shredding railroad ties sufficiently to liberate metallic components such as tie plates, spikes and end plates therein for easy magnetic removal in a subsequent operation. Railroad ties are loaded several at a time into the shredder and shredded as described herein, and the shredded remains fed out of the shredder onto a conveyor belt. Metallic components are removed by magnetic separation using a self-cleaning magnet over the conveyor. The shredded components are then ground in a secondary grinder, and an additional magnetic separation operation similar to the first is performed. Used railroad ties typically contain about 10–35% moisture, and are therefore drier than new ties, which typically contain about 40% moisture. The shredding of used ties therefore generates significant quantities of dust, such that it is desirable to use a baghouse for dust collection. The remaining shredded components are then suitable for use as fuel for generating electricity of other applications. The creosote used to preserve the wood enhances the fuel value of the ground tie material.

Figure 12:
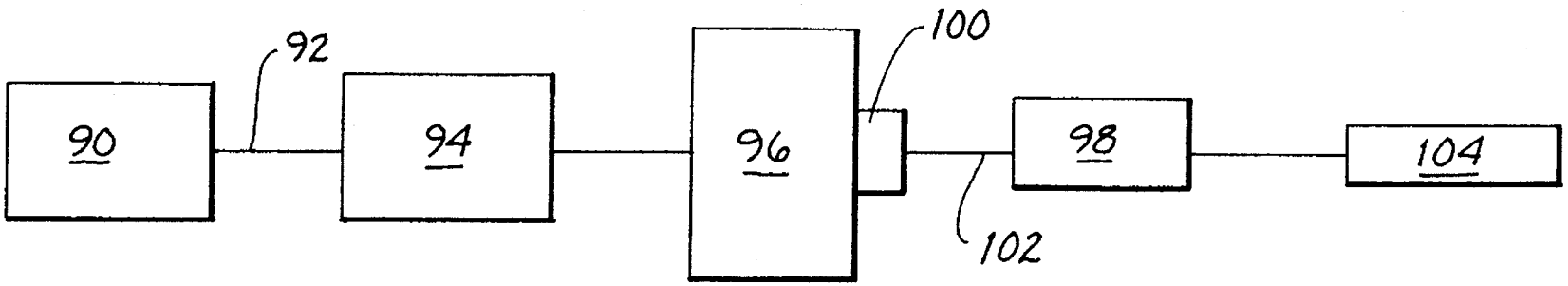
FIG. 12 is a schematic representation of the apparatus of the invention.

The shredder described above is a component of an apparatus shown schematically in FIG. 12 which has been discovered to be especially advantageous for shredding railroad ties to produce fuel therefrom. In addition to the primary shredder 90 as described above, there is a conveyor system 92 for carrying away shredded material discharged from the primary shredder. A first magnetic separator 94 removes metal components such as tie plates, spikes and the like from the shredded material discharged from the primary shredder. The magnetic separator comprises a magnet behind a moving belt suspended above the shredded material. The magnet pulls metal components against the moving belt, which moves the metal material attracted to the magnet away from the magnet. Rails projecting from the belt assist in moving the metal material away from the magnet. Secondary shredder 96 further shreds material discharged from the primary shredder, and dust collector 100 collects dust generated by the relatively fine shredding operation in the secondary shredder. A second conveyor system 102 carries shredded material away from the secondary shredder, and second magnetic separator 98 similar in construction to the first magnetic separator removes additional metal components from material discharged from the secondary shredder. The shredded material is loaded into trucks at truck load out station 104 for transportation to a fuel burning operation. This apparatus has been discovered to provide excellent control of the size and quality of fuel produced from railroad ties and the like.

The invention is further illustrated by the following example.

EXAMPLE

Railroad ties (approximate 8½ feet by 7 inches by 9 inches) are laid fed sequentially lengthwise into the shredder shown in FIG. 1. The auger is rotated at a speed of about 18–19 rpm by a motor having a capacity to provide about 75,000 ft-lbs of torque. The railroad ties are shredded primarily by action of the leading edges and shredding points of teeth on the periphery of the auger pulling the ties against the shredder blocks. The augering action of the shredder moves the tie material down the length of the shredder toward the discharge end, where shredded tie material is extruded through a 3 ft 10 inch diameter extrusion hole at the discharge end of the shredding chamber, where it free falls onto a conveyor belt, for transportation to subsequent operations. The discharged material has an average size of less than about two feet in length and 6 inches in diameter. The tie material being thus reduced, it is subjected to magnetic separation techniques to remove metallic components. The wooden tie material is then further reduced in a secondary shredding or grinding operation and subjected to further magnetic separation to produce fuel. The tie material contains combustible creosote in addition to wood and is thus especially suited as a fuel source.

In view of the above, it will be seen that the several objects of the invention are achieved and other advantageous results attained.

As various changes could be made in the above construction and methods without departing from the scope of the invention, it is intended that all matter contained in the above description or shown in the accompanying drawings shall be interpreted as illustrative and not in a limiting sense.

What is claimed is:

1. A shredder for shredding solid fracturable material comprising:

a shredder housing having side walls, a trough, a discharge end having a discharge aperture for discharge of shredded material out of said trough, and an opposite end remote from said discharge end;

an auger mounted for rotation within the shredder housing;

drive means for rotating the auger; and a plurality of teeth mounted on the periphery of the auger and projecting radially therefrom, at least some of said teeth having a leading shredding component and a trailing shredding component, the leading component leading the trailing component in the auger's direction of rotation during normal operation, said at least some teeth having a void between the leading component and the trailing component sized and shaped for receiving material being shredded therein for pulling said material in the direction of rotation to facilitate shredding of the material;

each of said teeth being separately and removably attached by fasteners to a shank which is attached to the auger at its periphery.

2. The shredder of claim 1 wherein each tooth has a sharp forwardly pointing shredder point above said void on a leading edge of the trailing shredding component of said tooth.

3. The shredder of claim 2 wherein said void has a periphery defined by a bottom edge, the shredder point, a void leading edge and a void trailing edge as the auger is rotated during normal operation and wherein the void is between about 2 and 6 inches wide from the void leading edge to the void trailing edge as the auger is rotated during normal operation and between about 1 and 6 inches deep from the shredder point to the bottom edge of the void.

4. The shredder of claim 3 wherein the void is about 3½ to 4 inches wide from the void leading edge to the void trailing edge and between about 1½ to 2½ inches deep from the shredder point to the bottom edge of the void.

5. The shredder of claim 1 wherein each of said shanks is welded to the auger at its periphery.

6. A shredder for shredding solid fracturable material comprising:

a shredder housing having a trough, a discharge end having a discharge aperture for discharge of shredded material out of said trough, and an opposite end remote from the discharge end;

an auger mounted for rotation within the shredder housing and retained by a bearing surface at the discharge end of the shredder housing and by a bearing surface at the opposite end of the shredder housing, said auger having an auger flight, a shaft of uniform diameter through its length which carries said flight, and a flight periphery of uniform diameter;

drive means located at the discharge end of the shredder housing for rotating the auger; and a plurality of teeth mounted on the periphery of the auger and projecting radially therefrom.

7. A shredder for shredding solid fracturable material comprising:

a shredder housing having side walls, a trough, a discharge end having a discharge aperture for discharge of shredded material out of said trough, and an opposite end remote from said discharge end;

an auger mounted for rotation within the shredder housing and retained by at least two thrust bearings in spaced relation to each other at the discharge end of the shredder housing and by a bearing surface at the opposite end of the shredder housing;

drive means for rotating the auger; and a plurality of teeth mounted on the periphery of the auger and projecting radially therefrom.

8. The shredder of claim 7 wherein there are exactly two of said thrust bearings which are spaced approximately 11 inches apart and disposed on opposite ends of an expanded section of the auger's shaft.

9. A shredder for shredding solid fracturable material comprising:

a shredder housing having a trough, a discharge end having a discharge aperture for discharge of shredded material out of said trough and an opposite end remote from the discharge end;

an auger mounted for rotation within the shredder housing and retained by a bearing surface at the discharge end of the shredder housing and by a bearing surface at the opposite end of the shredder housing, said auger having an auger flight, a shaft of uniform diameter in a section of the auger which carries said flight, and an auger flight periphery of uniform diameter;

drive means located at the discharge end of the shredder housing for rotating the auger;

a plurality of teeth affixed to the periphery of the auger and projecting radially therefrom, at least some of said plurality of teeth having a leading shredding component at a leading edge of each tooth as the auger is rotated and a trailing shredding component at a trailing edge of each tooth as the auger is rotated, the leading component leading the trailing component in the auger's direction of rotation during normal operation, there being a void between the leading component and the trailing component for receiving material being shredded therein for pulling said material in the auger's direction of rotation, said each tooth further having a sharp forwardly pointing shredder point on a leading edge of the trailing shredding component of said tooth; and a plurality of shredder members affixed to the trough, at least some of said members having adjacent side walls which define a corner, said members being arranged on the trough with said adjacent side walls in oblique relation relative to the auger's direction of rotation such that the corner of each member is disposed for first contact with material moving in the direction of said rotation.

10. Apparatus for shredding railroad ties and separating non-fuel useable components therefrom to produce fuel comprising:

a primary shredder having a shredder housing having a trough, a discharge end having a discharge aperture for discharge of shredded material out of said trough, and an opposite end remote from the discharge end, and an auger mounted for rotation within the shredder housing;

a first conveyor for carrying shredded material discharged from said primary shredder away from said primary shredder;

a first magnetic separator for removing metal components from shredded material discharged from the primary shredder;

a secondary shredder for further shredding material discharged from the primary shredder; and a second conveyor for carrying shredded material discharged from said secondary shredder away from said secondary shredder.

11. Apparatus of claim 10 comprising a second magnetic separator for removing metal components from material discharged from the secondary shredder.

12. Apparatus of claim 11 wherein the auger of the primary shredder is retained by a bearing surface at the discharge end of the shredder housing and by a bearing surface at the opposite end of the shredder housing, said auger having an auger flight, a shaft of uniform diameter through its length which carries said flight, and a flight periphery of uniform diameter, drive means located at the discharge end of the shredder housing for rotating the auger, and a plurality of teeth mounted on the periphery of the auger and projecting radially therefrom.

13. Apparatus of claim 11 wherein there are a plurality of teeth mounted on the periphery of the auger of the primary shredder and projecting radially therefrom, at least some of said teeth having a leading shredding component and a trailing shredding component, the leading component leading the trailing component in said auger's direction of rotation during normal operation, said at least some teeth having a void between the leading component and the trailing component sized and shaped for receiving material being shredded therein for pulling said material in the direction of rotation to facilitate shredding of the material.

14. Apparatus of claim 11 comprising a plurality of shredder members affixed to the trough of the primary shredder, at least some of said members having adjacent side walls which define a corner, said members being arranged on the trough with said adjacent side walls in oblique relation relative to the auger's direction of rotation such that the corner of each member is disposed for first contact with material moving in the direction of said rotation.

15. A method for shredding solid fracturable material comprising:

rotating an auger within shredder housing having a trough, a discharge end having a discharge aperture for discharge of shredded material out of said trough, and an opposite end remote from the discharge end;

placing the material within the housing and in contact with the auger so that teeth mounted on the periphery of the auger and projecting radially therefrom impact the material and cause it to be pulled against shredder members mounted on the trough, each tooth of at least some of the teeth having a leading shredding component at a leading edge of the tooth as the auger is rotated and a trailing shredding component at a trailing edge of the tooth as the auger is rotated, there being a void between the leading component and the trailing component for receiving material being shredded therein for pulling said material in the auger's direction of rotation, said each tooth further having a sharp forwardly pointing shredder point on a leading edge of the rearward shredding component of said tooth, at least some of said shredder members having adjacent side walls which define a corner, said members being arranged on the trough with said adjacent side walls in oblique relation relative to the auger's direction of rotation such that the corner of each member is disposed for first contact with material moving in the direction of said rotation.

* * * * *